United States Patent [19]

Maier

[11] 4,406,116

[45] Sep. 27, 1983

[54] YARN FALSE TWISTING APPARATUS HAVING FRICTION DISCS

[75] Inventor: Roland Maier, Radevormwald, Fed. Rep. of Germany

[73] Assignee: Barmag Barmer Maschinenfabrik AG, Remscheid, Fed. Rep. of Germany

[21] Appl. No.: 273,218

[22] Filed: Jun. 12, 1981

[30] Foreign Application Priority Data

Sep. 15, 1980 [DE] Fed. Rep. of Germany ..... 3034770
Feb. 11, 1981 [DE] Fed. Rep. of Germany ..... 3104788

[51] Int. Cl.[3] ..... D02G 1/08; D01H 7/92

[52] U.S. Cl. ..... 57/340; 57/339; 57/348

[58] Field of Search ..... 57/334–340, 57/348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 3,901,011 | 8/1975 | Schuster | 57/339 |
| 4,050,229 | 9/1977 | Hayahusa | 57/340 X |
| 4,145,871 | 3/1979 | Iwata et al. | 57/340 |
| 4,149,366 | 4/1979 | Bass et al. | 57/339 X |
| 4,195,470 | 4/1980 | Sturhahn | 57/337 X |
| 4,339,915 | 7/1982 | Dammann et al. | 57/348 X |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes
*Attorney, Agent, or Firm*—Bell, Seltzer, Park & Gibson

[57] ABSTRACT

A yarn false twisting apparatus is provided which includes a pair of twist imparting circular discs, with one of the discs being thin and flexible. A pressure applying member is positioned to upset the flexible disc toward the other disc at the twisting zone. In order to avoid undesired deformations of the flexible disc, the flexible disc includes reinforcing means, such as embedded reinforcing fibers, a reinforcing sheet, a discrete annular ring embedded in the material of the disc, or combinations thereof.

15 Claims, 16 Drawing Figures

FIG.1
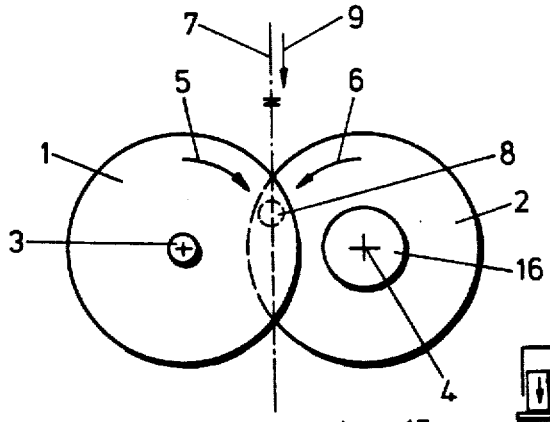
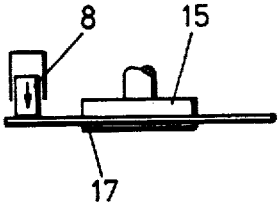
FIG.1b
FIG.1a
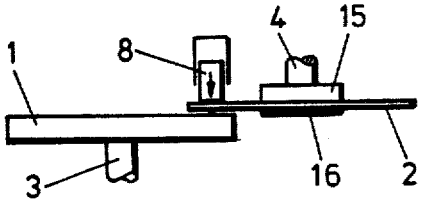
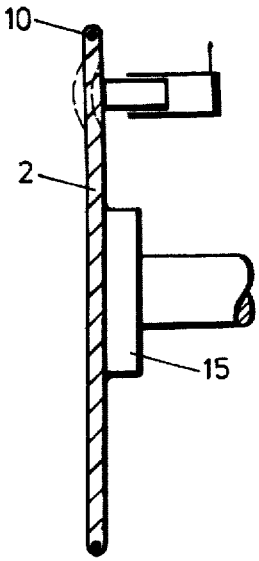
FIG.2

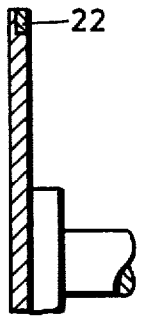
FIG.7
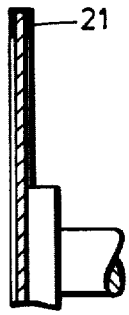
FIG.8
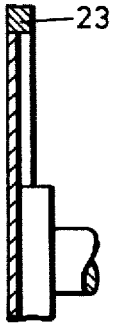
FIG.9
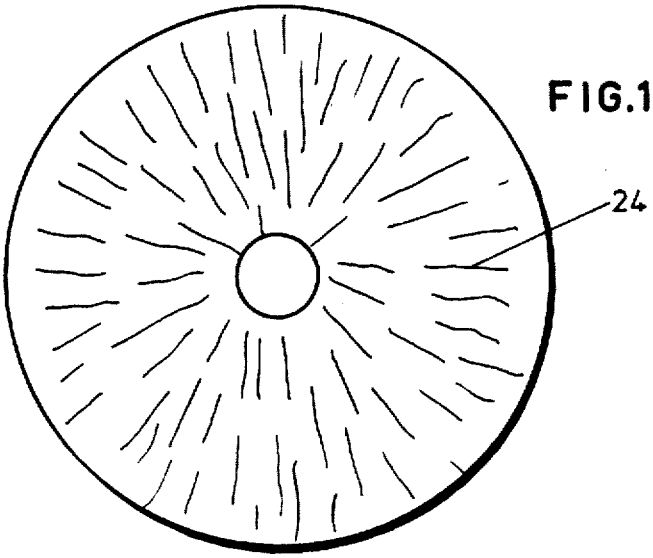
FIG.10
FIG.11
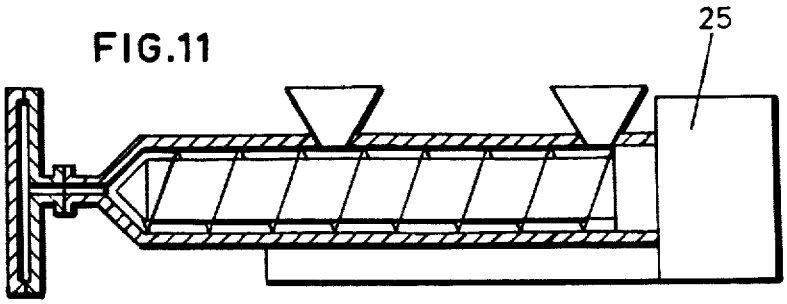

YARN FALSE TWISTING APPARATUS HAVING FRICTION DISCS

The present invention relates to an improved yarn false twisting apparatus, of the type disclosed in commonly owned copending application Ser. No. 168,734, filed July 14, 1980, now U.S. Pat. No. 4,339,915.

In copending application 168,734, there is disclosed an apparatus for false twisting a yarn which comprises a thin flexible or pliable disc mounted for rotation with a cooperating disc or roller to define a twisting zone between opposing friction surfaces thereof. A pressure applying member is mounted adjacent the back face of the disc for biasing the disc toward the other member locally at the twisting zone so as to firmly engage the yarn passing through the twisting zone, and while the friction surfaces remain in substantially non-contacting relationship with respect to each other. As a result, the yarn contacts the friction surfaces only in the narrowly limited and defined twisting zone. One particular advantage of this prior false twisting apparatus is the fact that the apparatus not only twists the yarn, but also effects its conveyance through the twisting zone. Also a very high degree of twist can be achieved.

A further advantage of the above described apparatus resides in the fact that the pressure applying member results in a defined nipping force which acts on the yarn, and whereby the slip can be controlled or influenced, and in particular, reduced. Furthermore, the normal force produced by the pressure applying member is operative in a narrowly limited and defined area so that the velocity vectors also can be accurately defined with respect to magnitude and direction. Finally, it has been found that the above friction false twisting apparatus is compatible with the required manufacturing and wear tolerances.

It has been found however that the bulging and deflection caused by the pressure applying member of the above described apparatus often leads to further undesirable deformations and interferes with a smooth rotation. It is an object of the present invention to further develop the friction false twisting apparatus according to the prior patent application so as to avoid this problem.

These and other objects and advantages of the present invention are achieved in the embodiments illustrated herein by the provision of a false twisting apparatus which includes a pair of twist imparting circular discs, with at least one of the discs being relatively thin and flexible. The discs are mounted such that their surfaces are disposed in opposing face to face relationship and define a twisting zone therebetween, and a pressure applying member is positioned to locally bias the flexible disc toward the other disc at the twisting zone. Further, the flexible disc includes reinforcing means for resisting the undesired deflection of the disc in both the radial and lateral directions.

Some of the objects and advantages of the invention having been stated, others will appear as the description proceeds, when taken in connection with the accompanying drawings, in which:

FIG. 1 is a schematic view of a yarn false twisting apparatus embodying the present invention;

FIG. 1*a* is a top plan view of the apparatus shown in FIG. 1;

FIG. 1*b* is a view similar to FIG. 1*a*, and illustrating a second embodiment of the invention;

FIGS. 2 through 9 are all side elevation views, partly sectioned, and illustrating various embodiments of the present invention;

FIG. 10 is a front elevation view of a flexible circular disc embodying the present invention;

FIG. 11 is a schematic view illustrating the method of manufacturing a friction disc according to FIG. 10;

Figure 3:
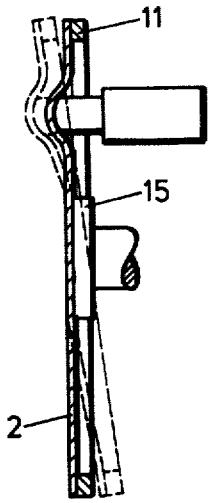

Referring more specifically to the drawings, the friction false twisting apparatus illustrated in FIGS. 1 and 1*a* consists of a rigid disc 1 and a flexible disc 2. The discs are supported on the rotatable shafts 3 and 4 respectively, so as to rotate in directions 5 and 6.

A pressure applying member 8 acts upon the back face of the flexible disc 2 so that the flexible disc is upset in a direction toward the rigid disc 1. By this arrangement, a yarn 7 running in the direction 9 is nipped in the pressure zone defined by the pressure applying member 8, which acts to twist the yarn and convey the yarn axially, since the discs not only exert a twist component in a direction transverse to the yarn axis, but also exert an axial component in its running direction. Further details concerning the above apparatus may be obtained from the above referenced copending application 168,734.

The flexible disc consists of a material or a compound material which can be easily deflected or upset in the lateral direction. For example, the disc 2 may consist of natural or synthetic rubber, polyurethane or any other elastomeric substance or material, which is suitable by reason of its physical properties and configuration, in particular its wall thickness, for absorbing high tensile forces and which presents only negligible resistance to lateral deflection or upsetting forces. Specifically, a flexible disc of rubber may have a wall thickness of about 0.5 to 2 mm. In this regard, it has already been proposed to insert cord or similar material into such flexible disc, which does not materially affect the ability of the disc to bend or upset laterally, but is suitable for absorbing the tensile loads occurring due to the centrifugal forces.

It is preferred that the flexible disc be formed of a material which is blended with fibers while in a fluid or plastic condition, such as fiberglass or synthetic fibers, and in such a manner that the fibers predominantly orient in a radial direction. For example, it is possible to initially mold a disc casting of an elastomeric material with the blended fibers which is then pressed beyond its yield point. The fibers then orient radially due to the resulting flow of the elastomeric material. For the same purpose, it is also proposed that a disc of elastomeric material with blended fibers may be made by an injection molding process, with the material being introduced into the center of the die mold so that a corresponding orientation of the blended fibers occurs by reason of the radial flow of the material.

It has been found that excellent texturing results can be achieved with such flexible and upsettable friction discs, aided by the pressure applying member 8 acting on the back side of the disc. However, this configuration of a flexible disc and pressure applying member has heretofore presented problems in attempting to achieve a stable and smooth run. To obtain a smooth run of the flexible disc, it is necessary that the position of the pressure applying member, the contact pressure, and the speed of the disc be very carefully controlled with respect to each other. Thereby, a compromise between a smooth run and the desired twist results may become necessary, since the position of the pressure applying member, the contact pressure, and the speed of the friction disc are also of critical importance for the amount and quality of the twist.

A smooth and stable run of the flexible friction disc is obtained independently of the position of the pressure applying member, the contact pressure and speed of the disc, in accordance with the present invention by designing the flexible disc so that it is less flexible in its peripheral portion, and more resistant to expansion in the circumferential direction, than in the intermediate area upon which the pressure applying member is operative. This greater resistance to bending, upsetting and expansion in the peripheral area can be obtained by the nature of material, the material thickness, and by inserting or mounting inserts in the peripheral area.

In the embodiment of the invention illustrated in FIG. 2, the flexible disc 2 has a constant thickness, and carries a discrete annular ring 10 of metal or other rigid material with a relatively high modulus of elasticity. The ring may be molded or cast in the disc, or pressed into the disc in the area of its outer periphery.

In the embodiment of FIG. 3, a ring 11 of metal or other similar material is affixed by glue or the like on the disc in the area of its outer periphery. Preferably, the ring is glued on the back side of the disc, i.e., the surface opposite the yarn engaging friction surface. It is also possible to glue this rigid ring on the other side, i.e., the friction side, if it is insured that there will be no contact between the ring and rigid disc 1.

It is to be noted that in accordance with the present invention, the rigid ring need not coincide with the outer circumference of the flexible disc. It is possible to also achieve a good smooth run by providing the flexible disc with a somewhat larger diameter than that of the ring. In any event, the inside diameter of the rigid ring or insert should extend radially beyond the point on which the pressure applying member engages the disc. It is also to be noted that in accordance with the present invention, the peripheral area should be able to absorb transverse forces. These forces may for example be applied perpendicularly to the surface tending to cause the rim to bend. They may also be applied by centrifugal forces, and in such case, tend to produce an expansion of the rim area. It has been found that the smooth run of the disc is improved by avoiding expansion. Therefore, it is preferred, that the rim area be resistant to expansion and to bending.

Resistance to bending and to expansion can be obtained in particular by metal inserts or mountings. Also, resistance to expansion may be obtained by embedded filament, cord or the like.

Figure 4:
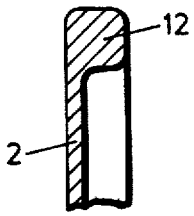

The embodiment of FIG. 4 provides a higher resistance to bending of the outer periphery of the flexible disc, by means of an enlargement 12 which is molded on and may consist of the same material as the disc 2. The enlargement provides a greater resistance to bending and a reduced expansibility due to its greater thickness. In molding the enlargement 12, it should be noted that the enlargement should not come into contact with the other friction surface, which may for example happen when the enlargement is so large that the forces result in the disc bending toward the other friction disc.

Figure 5:
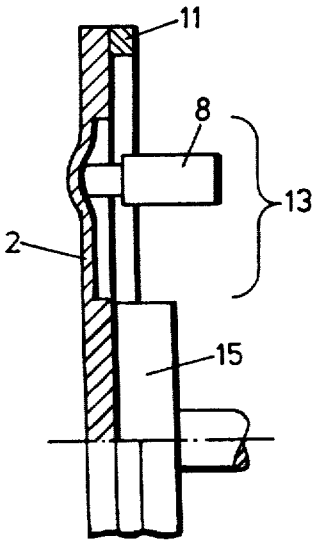

FIG. 5 illustrates an embodiment in which the flexible disc 2 is thin in only an annular intermediate area 13, which permits it to be upset and deflected by the normal force exerted by the pressure applying member 8. The remainder of the disc is sufficiently thick that it is relatively resistant to bending. In addition the outer periphery is reinforced by a ring 11 adhered thereto.

Figure 6:
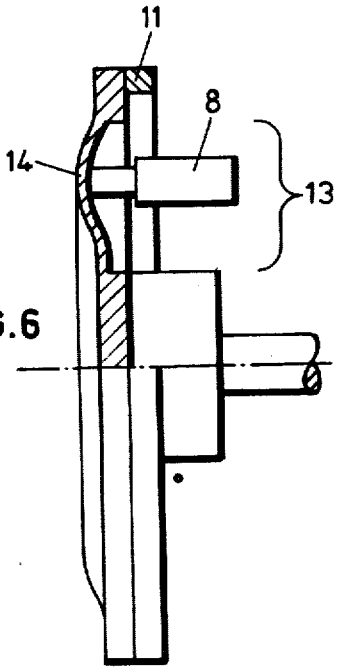

The embodiment of FIG. 6 is of similar form. However, in this case the flexible zone 13 is in the form of an annular, torus-like arcuate bulge 14, against which the pressure applying member 8 acts. This annular, torus-like bulge is preferably pre-molded in the material. By this arrangement, the bulging effect of the member 8 is increased, to further insure that the yarn is contacted only in the bulged area.

A characteristic of all illustrated embodiments is the fact that the flexible disc is mounted on a hub 15 having a relatively large diameter, whereby a further stabilization of the flexible disc is achieved.

According to the invention, a rim which is relatively resistant to bending or to expansion, may be deflected in a stable run at a certain angle, which in general does not exceed about 3 degrees, from the plane normal to its axis of rotation. This is illustrated in dashed lines in the embodiment of FIG. 3. However, this deflection may apply to all embodiments, and should be considered a further advantage of the invention insofar that the deflection from the normal plane leaves a free space for the thread line between the front surfaces of the friction discs.

In the embodiment of FIG. 7, a recess is formed in the outer periphery of the flexible disc, into which a ring 22 is inserted, and adhered by glue or vulcanizing.

In the embodiment of FIG. 8, a rigid rim is formed by placing a metallic ring 21 of U-shaped cross section upon the peripheral edge of the disc.

In the embodiment of FIG. 9, the outside periphery of the flexible disc is equal to the inside diameter of a rigid ring 23, with the ring 23 being glued or vulcanized to the disc.

The present invention is seen to simultaneously solve the problem of avoiding an unintended deflection of the flexible disc 2, which may be caused by the centrifugal forces. For this purpose, and as shown in FIGS. 1 and 1*a*, a thin metal disc 16, i.e., a disc having a high tensile strength, is glued on the friction surface of the flexible disc. The outside diameter of this disc is equal to that of the hub 15 on which the flexible disc is mounted. Typically, the metal disc 16 is about 1 mm thick and serves to prevent deformation of the flexible disc 2 by centrifugal forces in the area of the hub 15. A rigid flat annular ring 17 may serve the same purpose, which is shown in FIG. 1*b*. In FIG. 1*b*, only the flexible disc is illustrated, and the hub 15 is clamped, for example, by pressing the ring 17 onto the hub 15 by means of a screw connection.

FIG. 10 is a schematic front sectional view of a flexible disc reinforced with fibers 24. These reinforcement fibers may be blended into the elastomeric material of the disc while in a plastic condition. Subsequently, a predominant radial orientation may be effected for example, by subjecting the disc to heavy axial pressure by calendaring, or by means of a stamp, so that the material flows in the axial direction. FIG. 11 schematically illustrates an injection molding apparatus, in which the extruder 25 receives the elastomeric material and the fibers, such as fiberglass. The outlet of the extruder is connected to a disc shaped die mold, into which the material is injected from a center point. The blended fibers are radially oriented by the radial flow of the elastomeric material.

According to the present invention, it is also possible that the radial expansion of the flexible disc is prevented by embedding a tension resistant sheet in the disc, or placing it on the disc, and in particular, on the side upon which the pressure applying member is operative. In this regard, the proposed reduction of the radial expansion of the flexible disc also offers advantages for a greater inherent stability and smooth run, if the periphery or peripheral area of the flexible disc is not made resistant to bending or expansion as provided by this invention.

Figure 12:
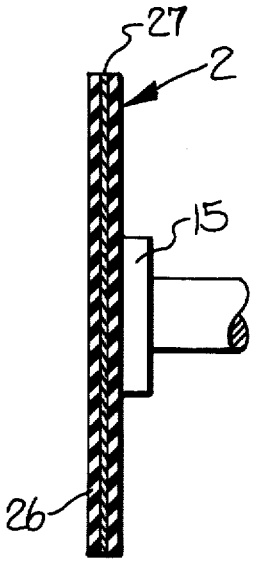
FIGS. 12 and 13 are sectional side elevation views of two additional embodiments of the present invention.

FIG. 12 illustrates the above described embodiment of the invention wherein the flexible disc 2 comprises an elastomeric material 26, and the reinforcing means comprises a tension resistant flexible sheet 27 embedded therein. The sheet 27 preferably has a higher elasticity module than that of the surface material 26. For example, the embedded sheet 27 may consist of a harder rubber material with a higher Shore hardness, which is reinforced by short fibers which are added to the compound used to extrude or injection mold the material. The embedded sheet 27 also should have substantially the same shrinkage properties as the surface material, to assure the disc has uniform soft surfaces.

Figure 13:
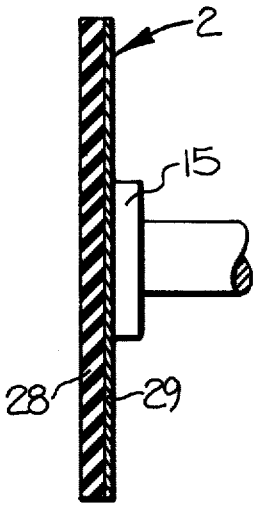

FIG. 13 illustrates the above described embodiment wherein the disc 2 comprises an elastomeric material 28 and the reinforcing means comprises a tension resistant sheet 29 overlying the surface opposite the yarn engaging friction surface. The sheet 29 thereby overlies the portion aligned with the pressure applying member 8, and the sheet 29 therefore preferably has a relatively low frictional resistance so a to minimize frictional contact with the member. The sheet 29 may for example consist of a thin metal foil having a thickness of only a few thousands of a millimeter, or a biaxially oriented foil material which may be pressed together with the friction material 28 in the mold.

Figure 14:
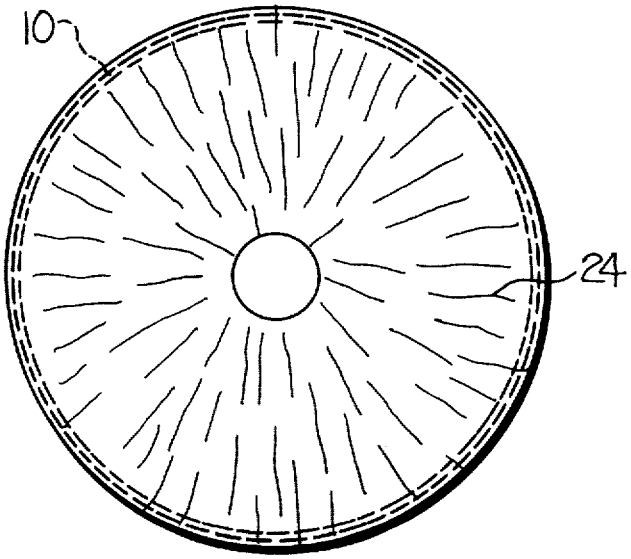
FIG. 14 is similar to FIG. 10, but illustrating a further embodiment wherein two different reinforcing measures are employed.

FIG. 14 illustrates a further embodiment wherein the reinforcing means comprises a combination of two distinct measures. In particular, the disc includes the embedded reinforcing fibers 24 as described above, plus a discrete annular ring 10 disposed adjacent the circular periphery of the disc. The ring 10 may be embedded in the material of the disc, or adhered to the surface opposite the friction surface.

In the drawings and specification, there has been set forth a preferred embodiment of the invention and although specific terms are employed, they are used in a generic and descriptive sense only and not for purposes of limitation.

That which is claimed is:

1. A yarn false twisting apparatus comprising a frame, a pair of twist imparting members, with each member including a yarn engaging friction surface, at least one of said members comprising a relatively thin and flexible, circular disc, and with said one flexible disc including reinforcing means for resisting undesired deflection thereof in both the radial and lateral directions, said reinforcing means including a distinct annular ring disposed adjacent the circular periphery of said disc, a pressure applying member mounted to said frame, means rotatably mounting said twist imparting members to said frame and such that portions of the respective yarn engaging friction surfaces are disposed in opposing, face to face relationship and define a twisting zone therebetween, and with said pressure applying member being positioned radially within said annular ring and so as to locally bias said one flexible disc toward the other twist imparting member only at said twisting zone, and drive means for operatively rotating each of said twist imparting members about their respective axes, and whereby a yarn may be continuously moved through said twisting zone while having twist imparted thereto by frictional contact between the yarn and the respective opposed friction surfaces resulting from the force exerted by said pressure applying member, whereby the reinforcing means of said one flexible disc acts to substantially alleviate undesired deformations and the non-stable rotation of such disc.

2. The yarn false twisting apparatus as defined in claim 1 wherein said disc comprises a relatively soft elastomeric material, and said annular ring comprises a discrete material adhered to said elastomeric material.

3. The yarn false twisting apparatus as defined in claim 2 wherein said ring is embedded in the material of said disc.

4. The yarn false twisting apparatus as defined in claim 2 wherein said ring is adhered to the surface of said disc.

5. The yarn false twisting apparatus as defined in claim 2 wherein said ring is adhered to the surface of said disc opposite the yarn engaging friction surface thereof.

6. The yarn false twisting apparatus as defined in claim 2 wherein the outside diameter of said ring essentially corresponds to that of said disc.

7. The yarn false twisting apparatus as defined in claim 2 wherein the periphery of said disc includes an annular recess, and said ring is fixedly disposed in said recess.

8. The yarn false twisting apparatus as defined in claim 2 wherein said ring has a U-shaped cross section and is disposed to overlie the peripheral edge of said disc.

9. The yarn false twisting apparatus as define in claim 2 wherein said ring is adhered to said peripheral edge of said disc.

10. The yarn false twisting apparatus as defined in claim 1 wherein said ring comprises an annular enlargement composed of the same material as said disc.

11. The yarn false twisting apparatus as defined in claim 1 wherein said disc is shaped to include an annular portion of reduced thickness, and wherein said twisting zone and pressure applying member are positioned in alignment with said annular portion.

12. The yarn false twisting apparatus as defined in claim 11 wherein said annular portion of reduced thickness is composed of a torus-like arcuate bulge.

13. The yarn false twisting apparatus as defined in claim 1 wherein said means rotatably mounting said disc to said frame includes a rigid hub fixed to said disc and extending radially a substantial distance from its axis of rotation.

14. The yarn false twisting apparatus as defined in claim 13 further comprising a circular rigid plate mounted to the surface of said disc opposite said hub and coaxially therewith.

15. The yarn false twisting apparatus as defined in claim 14 wherein said plate is in the form of a flat annular ring.

* * * * *